US007014290B2

(12) United States Patent
Chen et al.

(10) Patent No.: US 7,014,290 B2
(45) Date of Patent: Mar. 21, 2006

(54) METHOD AND RELATED APPARATUS FOR PERFORMING SHORT AND OPEN CIRCUIT TESTING OF INK JET PRINTER HEAD

(75) Inventors: Chi-Lun Chen, Hsin-Chu (TW); Hao-Feng Hung, Taipei (TW); Yao-De Huang, Hsin-Chuang (TW)

(73) Assignee: BenQ Corporation, Tao-Yuan Hsien (TW)

( * ) Notice: Subject to any disclaimer, the term of this patent is extended or adjusted under 35 U.S.C. 154(b) by 279 days.

(21) Appl. No.: 10/249,885

(22) Filed: May 14, 2003

(65) Prior Publication Data

US 2004/0017417 A1 Jan. 29, 2004

(30) Foreign Application Priority Data

May 16, 2002 (TW) ..... 91110286 A

(51) Int. Cl.
*B41J 29/393* (2006.01)

(52) U.S. Cl. ..... 347/19

(58) Field of Classification Search ..... 347/19, 347/50, 57, 58, 67, 92; 400/74
See application file for complete search history.

(56) References Cited

U.S. PATENT DOCUMENTS

| | | | |
|---|---|---|---|
| 5,376,854 A | 12/1994 | Oouchi | |
| 5,518,326 A | 5/1996 | Yoshino et al. | |
| 5,736,697 A | 4/1998 | Fuller et al. | |
| 5,736,997 A | 4/1998 | Bolash et al. | |
| 6,199,969 B1 * | 3/2001 | Haflinger et al. | 347/19 |

FOREIGN PATENT DOCUMENTS

| | | |
|---|---|---|
| JP | 07-237305 | 9/1995 |

* cited by examiner

*Primary Examiner*—K. Feggins
*Assistant Examiner*—Julian D. Huffman
(74) *Attorney, Agent, or Firm*—Winston Hsu

(57) ABSTRACT

Methods for detecting a short-circuit problem and an open-circuit problem in an ink jet printer. The ink jet printer includes at least an ink jet unit having an input end, a corresponding nozzle, and a control end. The ink jet printer further includes a driving circuit for providing energy to the ink jet unit via the input end. When the ink jet unit receives an ink jet signal via the control end, the ink jet unit can spray ink via the corresponding nozzle according to the energy received via the input end. The short-circuit problem detecting method includes stopping transmitting the ink jet signal to the control end of the ink jet unit, stopping providing energy to the input end of the ink jet unit, and measuring currents flowing through the input end of the ink jet unit.

18 Claims, 6 Drawing Sheets

METHOD AND RELATED APPARATUS FOR PERFORMING SHORT AND OPEN CIRCUIT TESTING OF INK JET PRINTER HEAD

BACKGROUND OF INVENTION

1. Field of the Invention

The present invention relates to an ink jet printer, and more particularly, to a method and related apparatus for detecting short-circuit and open-circuit problems of inkjet units of the inkjet printer.

2. Description of the Prior Art

Having advantages of low-cost and excellent printing performance, ink jet printers have become one of the most popular electrical output devices.

Please refer to FIG. 1, which is a schematic diagram of a circuit of a prior art printer 10 (U.S. Pat. No. 5,736,997). The printer 10 comprises a plurality of ink jet units A11 to A13, A21 to A23, and A31 to A33 disposed in matrix. The printer 10 further comprises a controller 12 for controlling the functionality of the printer 10, a power circuit 14 for providing energy to the ink jet units, an address circuit 16A for selectively controlling the ink jet units, a driving circuit 16B for selectively driving the ink jet units, and a detecting circuit 18. As each ink jet unit has the same structure, the ink jet unit A13 is described as an example. The ink jet unit A13 comprises a field effect transistor T, a heating element D, and a corresponding nozzle K. A gate electrode Tc of the transistor T serves as a control end of the ink jet unit A13. A source electrode of the ink jet unit A13 and a drain electrode of the ink jet unit A13 are respectively connected to ground and to one end of the heating element D. The other end of the heating element D is connected to a node Ti and serves as an input end of the ink jet unit A13. The heating element D is usually a resistor and is installed inside an ink container (not shown) of the ink jet unit A13 for transforming electrical energy into heat energy to heat the ink stored in the ink container when currents are flowing through the heating element D. When the temperature of the ink exceeds a threshold, the ink will spray via the corresponding nozzle K.

The address circuit 16A comprises three address lines Aa1, Aa2, and Aa3 corresponding to the three-row disposition of the plurality of ink jet units A11 to A13, A21 to A23, and A31 to A33. The address line Aa1 is connected to the control ends of the ink jet units A11, A12, and A13. The address line Aa2 is connected to the control ends of the ink jet units A21, A22, and A23. The address line Aa3 is connected to the control ends of the ink jet units A31, A32, and A33. The driving circuit 16B also comprises three driving lines Pa1, Pa2, and Pa3 corresponding to the three-column disposition of the plurality of ink jet units A11 to A13, A21 to A23, and A31 to A33. The driving line Pa1 is connected to the input ends of the ink jet units A11, A21, and A31. The driving line Pa2 is connected to the control ends of the ink jet units A12, A22, and A32. The driving line Pa3 is connected to the control ends of the ink jet units A13, A23, and A33. The controller 12 of the printer 10 determines the functionality of the ink jet units by controlling the address circuit 16A and by controlling the driving circuit 16B. For example, when the controller 12 determines that the ink jet unit A13 sprays ink, the address circuit 16A raises the voltage level of the address Aa1 by using the energy provided by the power circuit 14. The high level voltage of the address line Aa1 actuates the transistor T. At the same time, the driving circuit 16B raises the voltage of the driving line Pa3 also by using the energy provided by the power circuit 14. Then driving currents Id generated by the power circuit 14 flow through the driving line Pa3, to node Ti, and finally into the ink jet unit A13. The heating element D of the ink jet unit A13 transforms the electrical energy of the driving currents Id into heat energy, which will heat the ink stored in the ink jet unit A13 and will make the nozzle K of the ink jet unit A13 spray ink. On the contrary, when the controller 12 determines that the ink jet unit A12 needs not spray ink, the controller 12 will controls the address circuit 16A to keep the voltage of the ink jet unit A12 at low level. Thus, when the voltage of the address line Aa1 is at high level, the driving line Pa2 will not convey any currents to the ink jet unit A12. When the controller 12 also determines that the ink jet unit A23 needs not spray ink, the controller 12 will control the address circuit 16B to keep the voltage of the address line Aa2 at low level. The low level voltage of the address line Aa2 is not capable of actuating the transistor T of the ink jet unit Aa2, so the ink jet unit A23 still does not spray any ink even when the driving line Pa3 has been kept at high level.

Using the above-mentioned controlling process, the printer 10 is capable of controlling individual ink jet unit to accurately spray ink according to an image. However, the printer 10 usually has some circuit problems. For example, the inkjet unit A33 of the printer 10 has an open-circuit (OC) problem. No matter what voltage level the address line Aa3 is at, the driving-energy provided by the power circuit 14 will not flow through the driving line Pa3 into the ink jet unit A33. That is, the printer 10 is not capable of effectively controlling the functionality of the ink jet unit A33. As another example, the ink jet unit A32 of the printer 10 has a short-circuit (SC) problem (possibly due to a breakdown of the transistor T or to a malfunction of the heating element D). No matter what voltage level the address line Aa3 is at, whenever the driving circuit 16B raises the voltage of the driving line Pa2, because the driving line Pa2 is shorted to the ground, the currents flowing through the driving line Pa2 become extremely high. The extremely high current may damage the control logic circuit of the driving circuit 16B or may further damage the power circuit 14. Thus far the printer 10 is useless.

To detect the above short-circuit problem, the prior art printer 10 relies on a detecting circuit 18, as shown in FIG. 1. The detecting circuit 18 of the printer 10 comprises three diodes D1 to D3 respectively connected to the three driving lines Pa1 to Pa3. The detecting circuit 18 further comprises a comparator Vc1 for generating a detecting signal 18S. The comparator Vc1 has a positive end and a negative end. The negative end of the comparator Vc1 is connected to a resistor R1 and to the anodes of the three diodes D1 to D3. The positive end of the comparator Vc1 is connected to a voltage divider composed of a voltage source Vcc and two resistors R2, R3 by a contact point of the two resistors R2, R3. The functionalities of the detecting circuit 18 are described as follows. If the printer 10 functions normally (that is, no short-circuit problem), the three diodes D1 to D3 will be reverse biased and no currents will flow through the resistor R1. So the voltage of the negative end of the comparator Vc1 equals Vcc. In the meantime, the voltage of the positive end of the comparator Vc1 is always lower than Vcc due to the voltage dividing effect of the two resistors R2, R3. Therefore, the comparator Vc1 is capable of determining whether the printer 10 has any short-circuit problems by comparing the voltage of the positive end with the voltage of the negative end. If all the ink jet units of the printer 10 function normally, the detecting circuit 18 generates a corresponding functioning-normally detecting signal 18S. On the contrary, if the ink jet unit A32 has a short-circuit problem, as described previously, the voltage of the driving line Pa2 is decreasing, so the diode D2 actuates and currents flow through the resistor R1. Thus the voltage of the negative end of the comparator Vc1 is decreased. If the voltage of the negative end is lower than that of the positive end, the comparator Vc1 then determines that the printer 10 has a short-circuit problem.

Although the detecting circuit 18 of the printer 10 is capable of detecting a short-circuit problem, the previously-mentioned extremely high currents could have possibly already destroyed the address circuit 16A, the driving circuit 16B, and the power circuit 14 before the detecting circuit generates the detecting signal 18S (has detected the short-circuit problem). Furthermore, when the driving circuit 16B is raising the voltage of the driving line Pa3, the open-circuit effect occurring in the ink jet unit A33 will not affect the voltage of the driving line Pa3, so the detecting circuit 18 is not capable of detecting an open-circuit problem of any ink jet unit of the printer 10.

SUMMARY OF INVENTION

It is therefore a primary objective of the claimed invention to provide methods for detecting short-circuit and open-circuit problems of an inkjet printer. The short-circuit problem will not further damage the corresponding circuits of the printer during a short-circuit problem detecting process even if a short-circuit has appeared in the printer.

Methods for detecting a short-circuit problem and an open-circuit problem are used for an ink jet printer. The ink jet printer includes at least an ink jet unit having an input end, a corresponding nozzle, and a control end. The ink jet printer further includes a driving circuit for providing energy to the ink jet unit via the input end. When the ink jet unit receives an ink jet signal via the control end, the ink jet unit is capable of spitting ink via the corresponding nozzle according to the energy received via the input end. The short-circuit problem detecting method includes the following steps: stopping transmitting the ink jet signal to the control end of the inkjet unit, stopping providing energy to the input end of the inkjet unit, and measuring currents flowing through the input end of the inkjet unit. The open-circuit problem detecting method includes the following steps: transmitting the ink jet signal to the control end of the ink jet unit and measuring currents flowing through the input end of the inkjet unit.

It is an advantage of the claimed invention that the claimed invention is capable of detecting the short-circuit problem and the open-circuit problem. When the printer is proceeding with the short-circuit detecting process, the driving circuit does not drive the driving lines even if the short-circuit problem already exists. Such a process will not further damage the driving circuit, power circuit, or any other important circuits of the printer. When the printer is proceeding with the open-circuit detecting process, the controller is capable of detecting what ink jet unit has open-circuit problems, what resistor is useless, or what switch of the printer has malfunctioned.

These and other objectives of the claimed invention will no doubt become obvious to those of ordinary skill in the art after reading the following detailed description of the preferred embodiment that is illustrated in the various figures and drawings.

DETAILED DESCRIPTION

Figure 1:
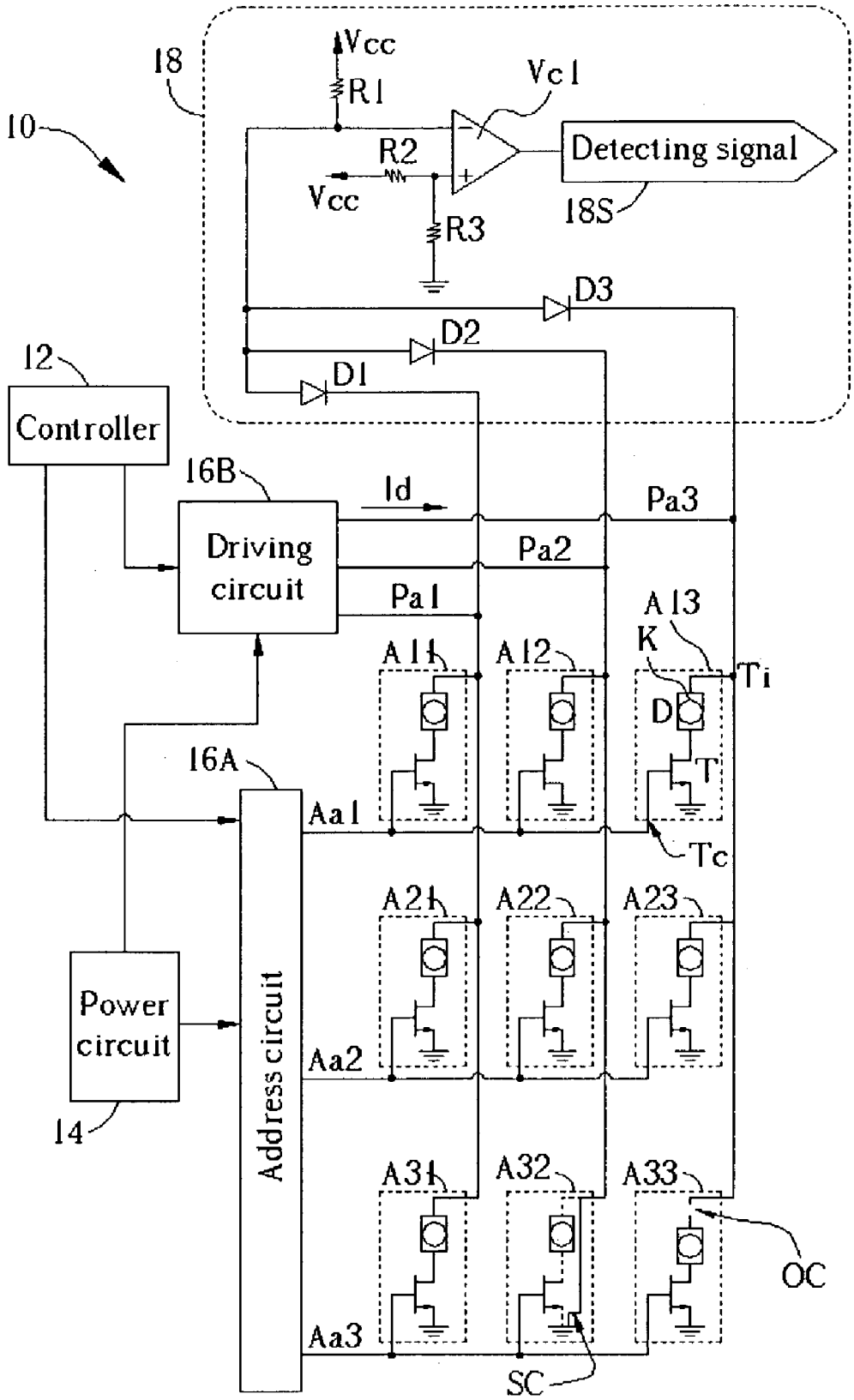
Fig. 1 Prior art
FIG. 1 is a schematic diagram of a circuit of a prior art printer.
Figure 2:
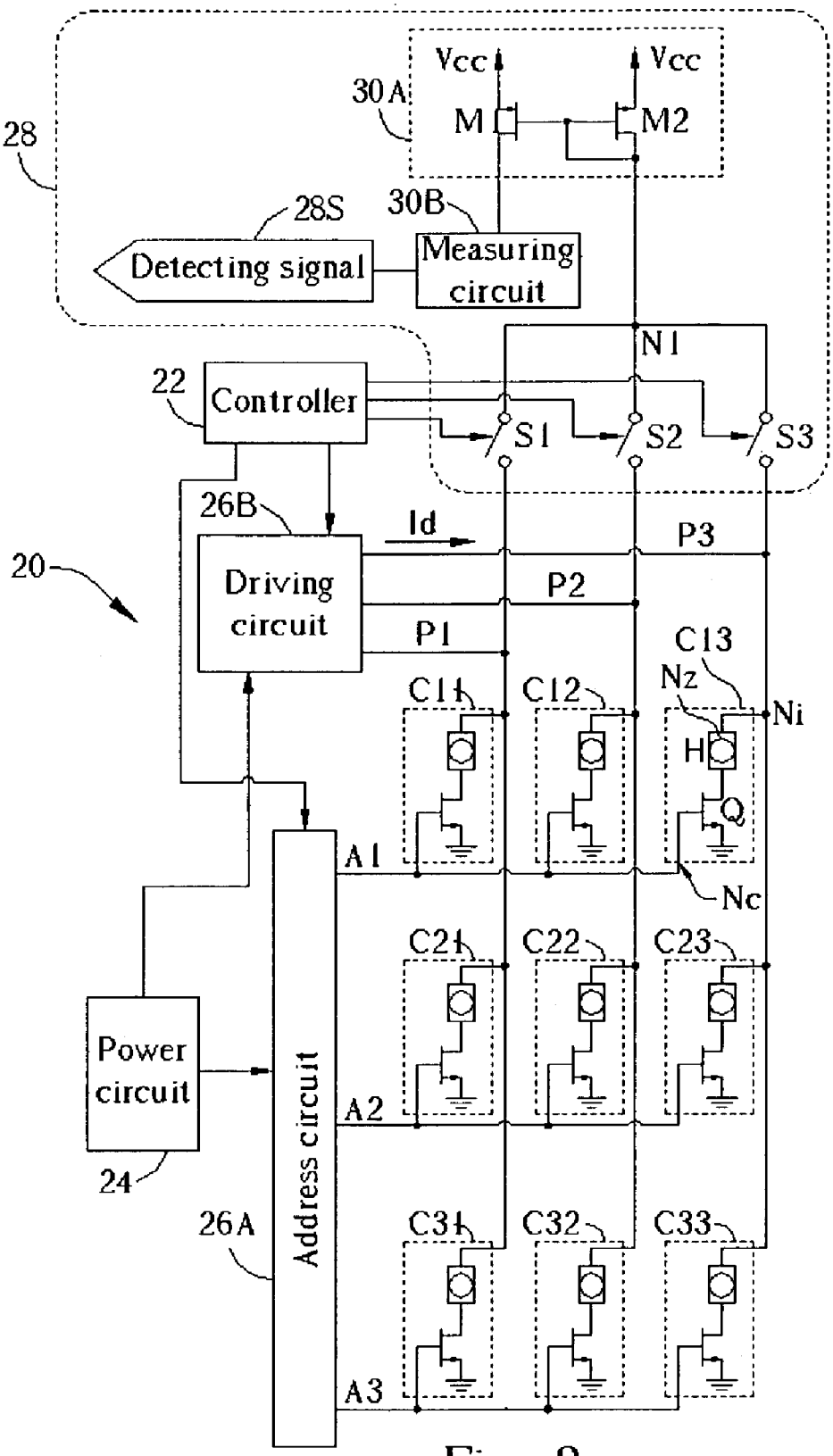
FIG. 2 is a schematic diagram of a circuit of a printer according to the present invention.

Please refer to FIG. 2, which is a schematic diagram of a circuit of a printer 20 according to the present invention. The printer 20 comprises a plurality of ink jet units C11 to C13, C21 to C23, and C31 to C33 disposed in matrix. The printer 20 further comprises a controller 22 for controlling the functionality of the printer 20, a power circuit 24 for providing energy to the ink jet units, an address circuit 26A for selectively controlling the ink jet units, a driving circuit 26B for selectively driving the ink jet units, and a detecting circuit 28 for detecting an open-circuit problem and a short-circuit problem. As each ink jet unit has the same structure, the ink jet unit C13 is described as an example. The ink jet unit C13 comprises a field effect transistor Q, a heating element H, and a corresponding nozzle Nz. A gate electrode Nc of the transistor Q serves as a control end of the ink jet unit C13. A source electrode of the ink jet unit C13 and a drain electrode of the ink jet unit C13 are respectively connected to ground and to one end of the heating element H. The other end of the heating element H is connected to a node N1 and serves as an input end of the ink jet unit C13. The address circuit 26A comprises three address lines A1, A2, and A3 corresponding to the three-row disposition of the plurality of inkjet units C11 to C13, C21 to C23, and C31 to C33. The address line A1 is connected to the control ends of the ink jet units C11, C12, and C13. The address line A2 is connected to the control ends of the ink jet units C21, C22, and C23. The address line A3 is connected to the control ends of the ink jet units C31, C32, and C33. The driving circuit 26B comprises three driving lines P1, P2, and P3 corresponding to the three-column disposition of the plurality of ink jet units C11 to C13, C21 to C23, and C31 to C33. The driving line P1 is connected to the input ends of the ink jet units C11, C21, and C31. The driving line P2 is connected to the control ends of the ink jet units C12, C22, and C32. The driving line P3 is connected to the control ends of the ink jet units C13, C23, and C33. The controller 22 of the printer 20 determines the functionality of the inkjet units by controlling the address circuit 26A and by controlling the driving circuit 26B. For example, if the controller 22 determines that the ink jet unit C13 is about to spray ink, the address circuit 26A raises the voltage level of the address A1 by using the energy provided by the power circuit 24. The high level voltage of the address line Al actuates the transistor Q. In the meantime, the driving circuit 26B raises the voltage of the driving line P3 also by using the energy provided by the power circuit 24. Driving currents generated by the power circuit 24 then flow through the driving line P3, to node N1, and finally into the ink jet unit C13. The heating element H of the ink jet unit C13 transforms the electrical energy of the driving currents into heat energy, which will heat the ink stored in the ink jet unit C13 and will make the nozzle Nz of the ink jet unit C13 spray ink. On the contrary, if the controller 22 of the printer 20 determines that the ink jet unit C12 need not spray any ink, the address circuit 26A then keeps the voltage of the ink jet unit C12 at low level. Thus, even if the voltage of the address line A1 is at high level, the driving line P2 still will not convey any currents to the ink jet unit C12. If the controller 22 also determines that the ink jet unit C23 need not spray ink, the controller 22 controls the address circuit 26A to keep the voltage of the address line A2 at low level. The low level voltage of the address line A2 is not capable of actuating the transistor Q, so the ink jet unit C23 does not spray any ink even if the driving line P3 has been kept at high level.

The detecting circuit 28 of the printer 20 comprises a current-providing circuit 30A (inside dotted lines shown in FIG. 2), a measuring circuit 30B, and three switches S1 to S3. The current-providing circuit 30A is a current mirror, which is formed by two transistors M1, M2, and a DC power Vcc. A current end of the current-providing circuit 30A is connected to a node N1 and provides currents to the inkjet units. One electrode of the transistor M1 is connected to the measuring circuit 30B. The measuring circuit 30B generates a detecting signal 28S to report a short-circuit problem or to report an open-circuit problem according to currents flowing from the transistor M1. The three switches S1 to S3 are respectively connected between the corresponding driving lines Pa1 to Pa3 and the current end (at node N1) of the current-providing circuit 30A. The controller 22 controls the functionalities of the three switches S1 to S3. For example, when the switch S1 is closed, the driving line P1 is electrically connected to node N1 current end of the current-providing circuit 30A; when the switch S1 is opened, the driving line P1 is not electrically connected to the current end. The three switches S1 to S3 are opened when the printer 20 is proceeding with printing processes.

Figure 3:
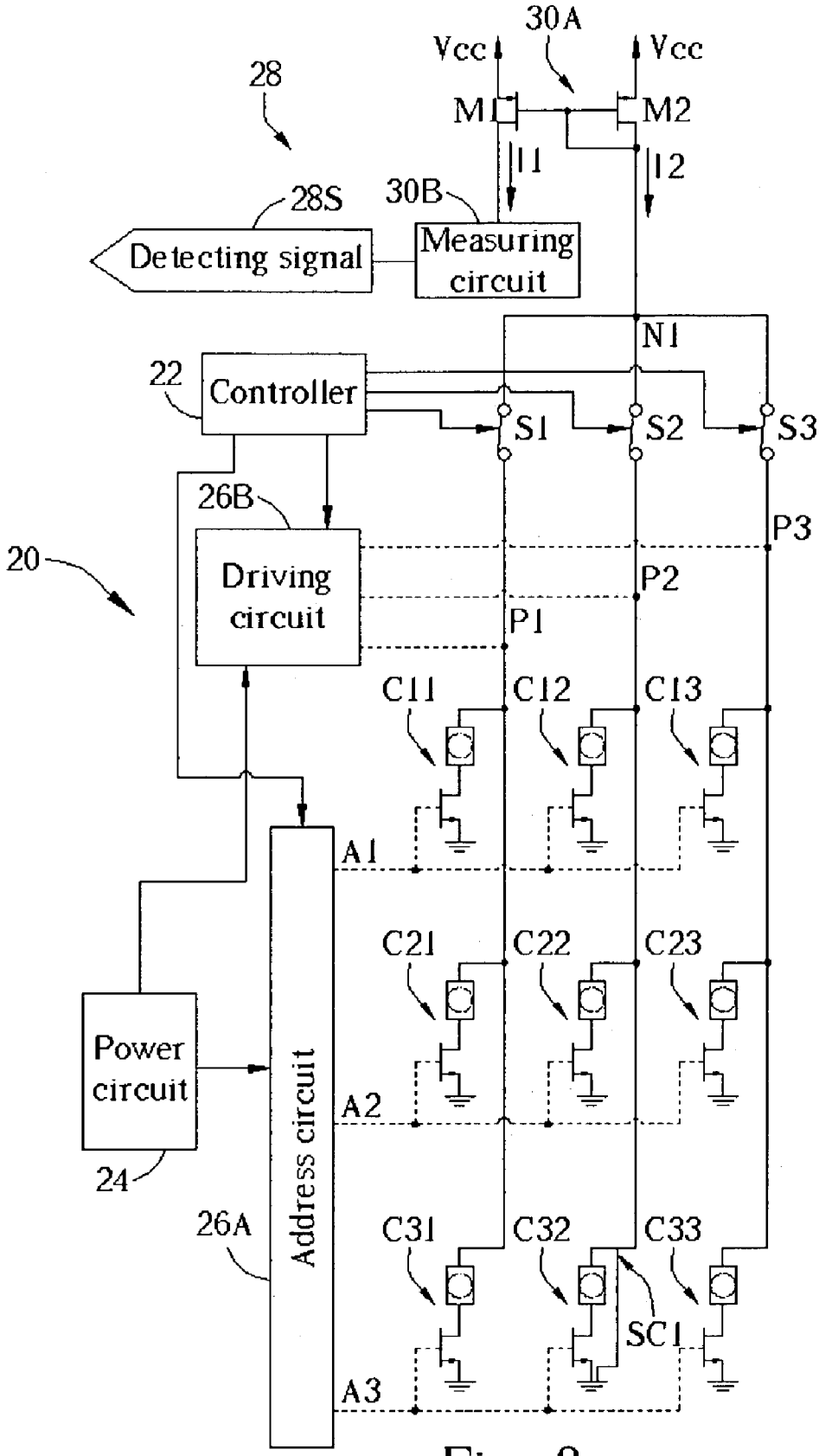
FIG. 3 is a schematic diagram of the printer when the printer is proceeding with a short-circuit problem detecting process.

Please refer to FIG. 3, which is a schematic diagram of the printer 20 when the printer 20 is proceeding with a short-circuit problem detecting process. The voltages of all the address lines of the address circuit 26A are kept at low level (represented by dotted lines shown in FIG. 2). At the same time, the controller 22 closes the three switches S1 to S3. Thus the three address lines P1 to P3 are capable of connecting to the current-providing circuit 30A via node N1. The driving circuit 26B also stops driving the three address lines P1 to P3 (represented by dotted lines shown in FIG. 2). If all the ink jet units function normally, because the voltage of all the address lines are kept at low level, no transistors actuate. Therefore, no currents flow through the three driving lines P1 to P3. No currents flowing through the three driving lines is equivalent to a large resistance being connected between node N1 and the three driving lines. So, currents 12, which flow through the transistor M2, are small. Currents 11, which flow through the transistor M1, are also small due to the mirror effect. When measuring the small currents 11, the measuring circuit 30B determines that no short-circuit problems occur in any ink jet units and then generates a detecting signal 28S to report that no ink jet unit has any short-circuit problem. On the contrary, if at least one ink jet unit has a short-circuit problem, such as ink jet unit C32 and a short-circuit route SC1 shown in FIG. 3, an equivalent small resistance between node 1 and the ground is formed. The equivalent small resistance results in large currents flowing through the transistor M2 and through the transistor M1 due to the mirror effect. When measuring the large currents 11, the measuring circuit 30B then determines that short-circuit problems occur in some ink jet units and then generates a detecting signal 28S to report the short-circuit problems of the printer 20. As soon as the detecting circuit 28 has detected any short-circuit problems occurring in the ink jet units, the controller 22 controls the power circuit 24 and controls the driving circuit 26B to stop functioning. Therefore, severe damage caused by the large currents 12 is prevented. In practice, the measuring circuit 30B usually compares the currents 11 with a predetermined currents level. When the currents 11 are less than the predetermined currents level, the printer 20 does not have any short-circuit problem. When the currents 11 are greater than the predetermined current level, at least one inkjet unit of the printer 20 has a short-circuit problem.

In the above-described short-circuit problem detecting process of the printer 20, because the driving circuit 26B will not raise the voltages of the three driving lines P1 to P3 during the short-circuit detecting process, the short-circuit problem is not capable of damaging the driving circuit 26B or of damaging the power circuit 24. Since the currents 12 are provided by the voltage source Vcc, the level of the voltage source Vcc can be set lower than that of the working voltage of the printer 20 so as to further protect the driving lines from damaging during the short-circuit problem detecting process. Furthermore, the short-circuit problem detecting process of the present invention is also capable of detecting the short-circuit problems occurring on the driving lines. For example, to detect if the driving line P1 has any short-circuit problems, the switch S1 is closed and the switches S2, S3 are opened. Then only those ink jet units connected to the driving line P1 will affect the equivalent resistance at node N1. If those ink jet units connected to the driving line P1 have any short-circuit problems, the low equivalent resistance at node N1 makes the currents 12, 11 increase. In such a circumstance, because the switches S2. S3 are opened, the short-circuit problems of the inkjet units connected to the remaining driving lines P2, P3 will not affect results of the short-circuit problem detecting process performed on the driving line P1.

Figure 4:
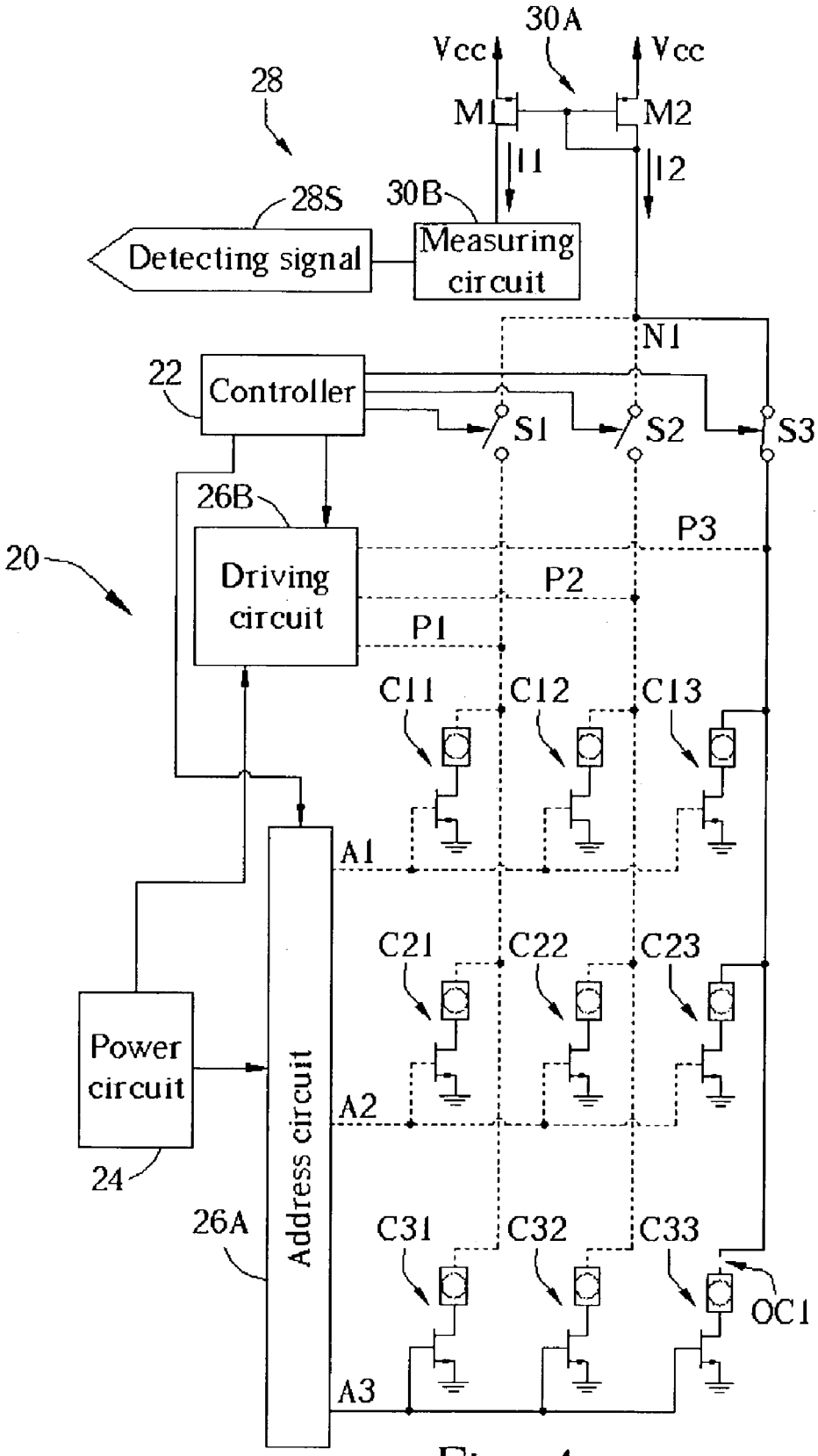
FIG. 4 is a schematic diagram of the printer when the printer is proceeding with an open-circuit detecting process.

In addition to the short-circuit detecting process, the printer 20 is capable of proceeding with an open-circuit detecting process on the inkjet units of the printer 20. Please refer to FIG. 4, which is a schematic diagram of the printer 20 when the printer 20 is proceeding with an open-circuit detecting process. The controller 22 of the printer 20 opens the switches S1, S2 and closes the switch S3, which is connected to the driving line P3 and is connected to the ink jet unit C33. At the same time, the controller 22 controls the address circuit 26A to raise the voltage of the address line A3, which is connected to the inkjet unit C33. The voltage-raised address line A3 actuates the transistor Q of the ink jet unit C33. The address circuit 26A keeps the remaining address lines A1, A2 at low voltage level. The low voltage level address lines A1, A2 and the driving lines P1, P2, which are not connected to node N1 due to the opened switches S1, S2, are illustrated with dotted lines and are shown in FIG. 4. For the time now only the ink jet unit C33 is actuated by the address line A3 and is electrically connected to node N1 via the closed switch S3. If the ink jet unit C33 functions normally, the transistor Q of the ink jet unit C33 will actuate due to the high voltage of the address line A3. The actuated transistor Q is equivalent to a resistor with a small resistance connecting between the ground and node N1. So, the transistor M2 actuates large currents 12, which correspondingly induce another large current 11 to flow through the transistor M1 due to the mirror effect. As the measuring circuit 30B measures the large current 11, the measuring circuit 30B then generates a detecting signal to report that the ink jet unit C33 does not have any open-circuit problem. On the contrary, if the ink jet unit C33 indeed has an open-circuit problem and has an opened route OC1, the opened route OC1 is equivalent to a resistor with an extremely large resistance connecting between the ground and node N1. So the transistor M2 only actuates small currents 12, which correspondingly induce another small current 11 flowing through the transistor M1 due to the mirror effect. As the measuring circuit 30B measures the small current 11, the measuring circuit 30B generates a detecting signal to report that the ink jet unit C33 has an open-circuit problem. The controller 22 is capable of detecting the open-circuit problem for each ink jet unit by sequentially raising the voltage of the address line corresponding to the ink jet unit and by sequentially closing the switch corresponding to the ink jet unit. Because the controller 22 of the printer 20 is not capable of controlling an ink jet unit having an open-circuit problem to spray ink, if an ink jet unit has an open-circuit problem, the controller 22 will control another ink jet unit, neighboring to the malfunctioned ink jet unit, to spray ink when the malfunctioned ink jet unit is determined to spray ink.

In summary, no matter what problem detecting process the printer 20 is proceeding with, the driving circuit 26B neither raises the voltage of the three driving lines P1 to P3 nor transmits any energy to the three driving lines P1 to P3. When the printer 20 is proceeding with the short-circuit detecting process, the controller 22 keeps the voltages of the three address lines A1 to A3 at low level and closes the three switches S1 to S3 to respectively electrically connect the three driving lines P1 through P3 to node N1. If an ink jet unit of the printer 20 has a short-circuit problem, an extremely small equivalent resistance appears at node N1. The small equivalent resistance at node N1 results that the transistor M2 generates extremely large currents, which induce another extremely large current to flow through the transistor M1. If the ink jet units of the printer 20 all function normally, an extremely large equivalent resistance appears at node N1. The large equivalent resistance at node N1 results that the transistor M2 generates extremely small currents, which induce another extremely small current to flow through the transistor M1. When the printer 20 is proceeding with the open-circuit detecting process, the controller 22 keeps the voltage of the address line, which is connected to a specific ink jet unit, at low level and closes the corresponding switch electrically connected to the specific ink jet unit. If the specific ink jet unit functions normally, an extremely small equivalent resistance appears at node N1. The small equivalent resistance at node N1 results that the transistor M2 generates large currents, which induce another large current to flow through the transistor M1. If the specific inkjet unit has an open-circuit problem, an extremely large equivalent resistance appears at node N1. The large equivalent resistance results that the transistor M2 generates small currents, which induce another small current to flow through the transistor M1. The detecting circuit 28 generates a corresponding detecting signal 28S by determining the currents flowing from the transistor M1.

Figure 5:
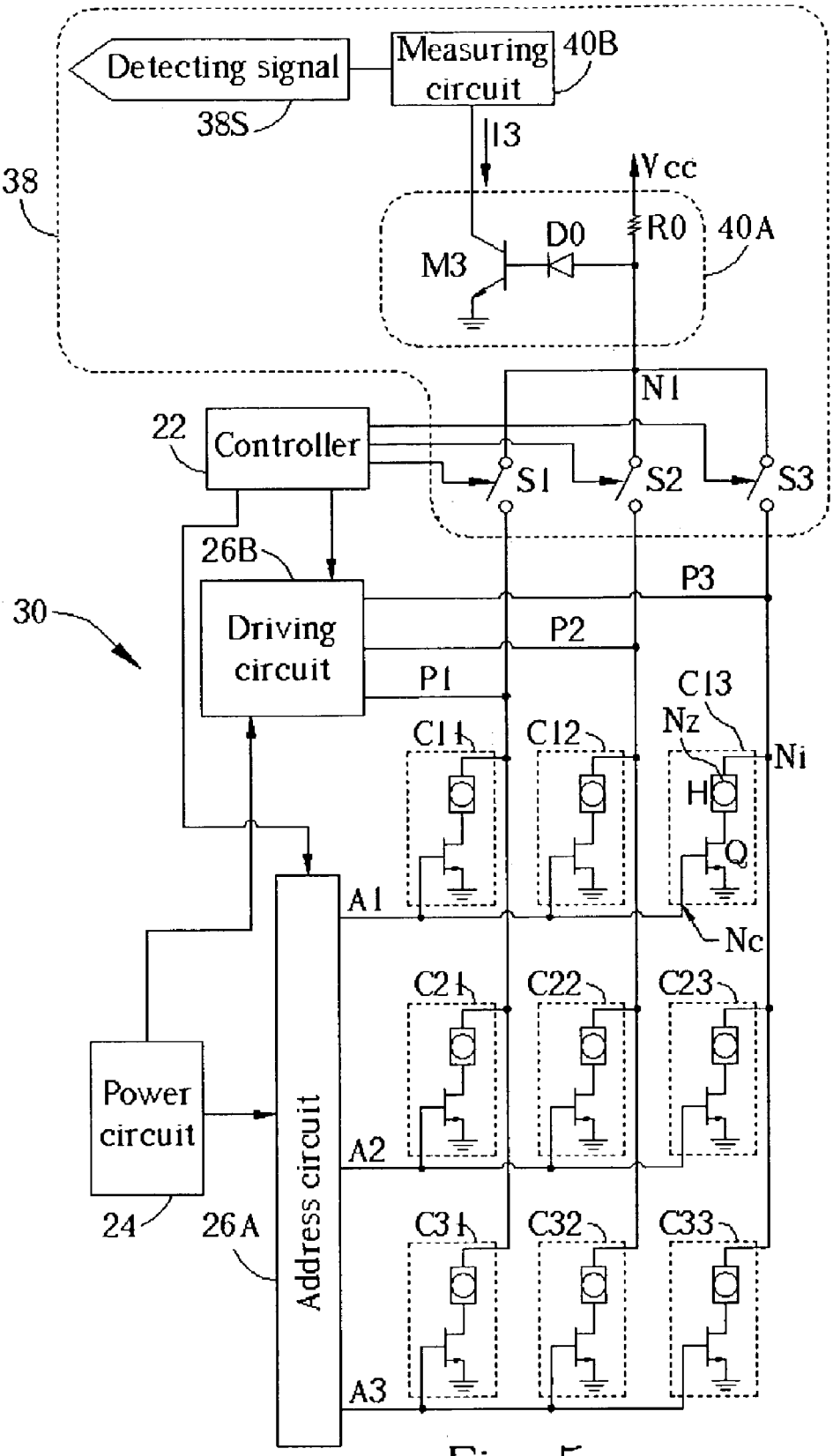
FIG. 5 and FIG. 6 are two schematic diagrams respectively corresponding to another two printers according to the present invention.
Figure 6:
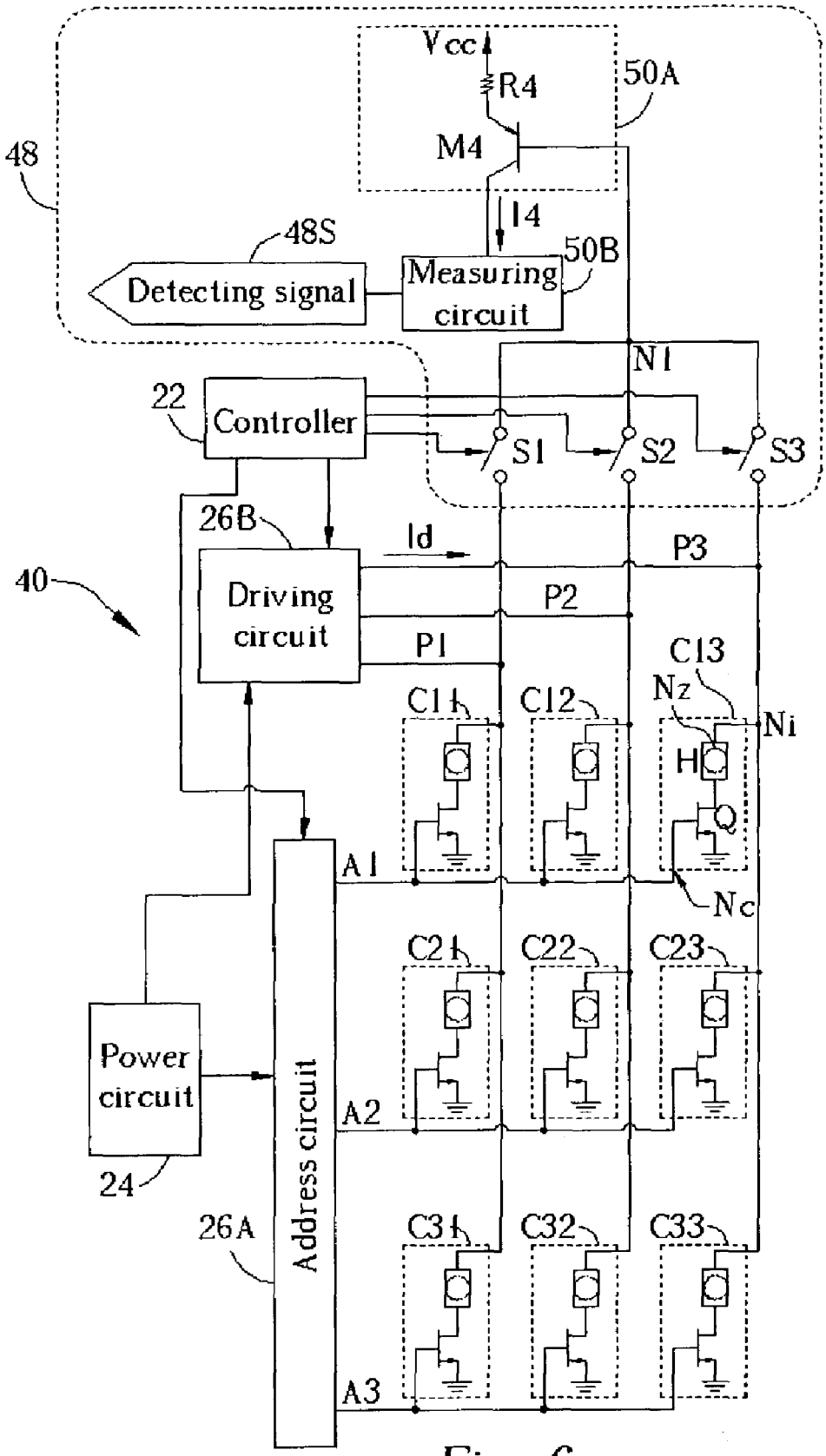

Please refer to FIG. 5 and FIG. 6. FIG. 5 and FIG. 6 are two schematic diagrams respectively corresponding to another two printers 30, 40 according to the present invention. Printers 30, 40 and the printer 20 respectively comprise the same elements except the detecting circuit. The detecting circuit 38 of the printer 30, shown in FIG. 5, comprises not only three switches S1 to S3 but also a current-providing circuit 40A and a measuring circuit 40B for generating a detecting signal 38S. The current-providing circuit 40A comprises a resistor R0, a diode D0, and a bipolar junction transistor M3. A base electrode of the transistor M3 is connected to a cathode electrode of the diode D0. An anode electrode of the diode D0 is connected to node N1 and serves as a current end of the current-providing circuit 40A. One end of the resistor R0 is connected to the anode electrode of the diode D0 and the other end of the resistor R0 is connected to the voltage source Vcc. An emitter electrode of the transistor M3 is connected to the ground. A collector electrode of the transistor M3 is connected to the measuring circuit 40B. When node N1 is connected to an equivalent resistor with a large resistance, currents flowing through the resistor R0 will be small. The small currents keep the voltage of the anode electrode of the diode D0 at high level and consequently actuate the diode D0. The actuated diode D0 keeps the voltage of the base electrode of the transistor M3 at high level. The transistor M3 actuates too. The actuated transistor M3 actuates large currents 13. On the contrary, when node is connected to an equivalent resistor with a small resistance, currents flowing through the resistor R0 is large. The large currents keep the voltage of the anode electrode of the diode D0 at low level and consequently do not actuate the diode D0. The transistor M3 does not actuate either, so the currents 13 are very small.

The detecting circuit 48 of the printer 40, shown in FIG. 6, also comprises a current-providing circuit 50A and a measuring circuit 50B. The current-providing circuit 50A comprises a bipolar junction transistor M4 and a resistor R4. A base electrode of the transistor M4 is connected to node N1 and serves as a current end of the current-providing circuit 50A. An emitter electrode of the transistor M4 is connected to one end of the resistor R4. The other end of the resistor R4 is connected to the voltage source Vcc. A collector electrode of the transistor M4 is connected to the measuring circuit 50B. When node N1 is connected to an equivalent resistor with a large resistance, the transistor M4 does not actuate and consequently currents 14, flowing through the transistor M4, are very small. When node N1 is connected to an equivalent resistor with a small resistance, the voltage of the base electrode of the transistor M4 is reduced and then the transistor M4 is actuated. The actuated transistor M4 actuates currents 14 to flow through the transistor M4. Therefore, the measure circuit 50B is capable of generating a corresponding detecting signal 48S by determining the level of the currents 14. No matter what process (the short-circuit detecting process or the open-circuit detecting process) the printer 30 or the printer 40 is proceeding with, the functionalities of the corresponding address lines, driving lines, and switches are the same as those of the printer 20 illustrated in the FIG. 2 through FIG. 4, so further discussion is omitted.

In contrast to the prior art printer, which is only capable of proceeding with the short-circuit detecting process, the present invention printer is capable of detecting the short-circuit problem and of detecting the open-circuit problem. When the printer is proceeding with the short-circuit detecting process, the driving circuit does not drive the driving lines even if the short-circuit problem already exists. Such a process will not further damage the driving circuit, power circuit, or any other important circuits of the printer. When the printer is proceeding with the open-circuit detecting process, the controller is capable of detecting what ink jet unit has open-circuit problems, what resistor is useless, or what switch of the printer is malfunctioned.

Following the detailed description of the present invention above, those skilled in the art will readily observe that numerous modifications and alterations of the device may be made while retaining the teachings of the invention. Accordingly, the above disclosure should be construed as limited only by the metes and bounds of the appended claims.

What is claimed is:

1. A method for detecting a short-circuit problem in an ink jet printer, the ink jet printer comprising:

at least an ink jet unit comprising an input end, a corresponding nozzle, and a control end;

a driving circuit for providing energy to the ink jet unit via the input end; and a switch connected to the input end of the ink jet unit, wherein when the ink jet unit is receiving energy provided by the driving circuit, the switch is opened;

wherein when the ink jet unit receives an ink jet signal via the control end, the ink jet unit is capable of spitting ink via the corresponding nozzle according to the energy received via the input end;

the method comprising:

stopping transmitting the ink jet signal to the control end of the ink jet unit;

stopping providing energy to the input end of the ink jet unit; and measuring currents flowing through the input end of the ink jet unit and the switch when the switch is closed.

2. The method of claim 1 wherein when proceeding with measuring currents flowing through the input end of the ink jet unit, if the currents flowing through the input end of the ink jet unit are different from a predetermined value, the method further comprises reporting that the ink jet unit has a short-circuit problem.

3. The method of claim 2 wherein the ink jet printer further comprises a current-providing circuit having a current end, and the current-providing circuit is capable of providing currents flowing through the current end according to a resistance of the current end; the method further comprises connecting the input end of the ink jet unit to the current end of the current-providing circuit when proceeding with measuring currents flowing through the input end of the ink jet unit.

4. The method of claim 3 wherein the switch is electrically connected between the current end of the current-providing circuit and the input end of the ink jet unit for controlling the electric connection between the current end and the input end; the method further comprises closing the switch to connect the input end to the current end when proceeding with connecting the input end of the ink jet unit to the current end of the current-providing circuit.

5. The method of claim 1 further comprising stopping providing energy to the ink jet unit if the ink jet unit has a short-circuit problem.

6. The method of claim 1 wherein the driving circuit and the switch are controlled independently of one another.

7. A method for detecting an open-circuit problem in an ink jet printer; the ink jet printer comprising:

at least an ink jet unit comprising an input end, a corresponding nozzle, and a control end;

a driving circuit for providing energy to the ink jet unit via the input end; and a switch connected to the input end of the ink jet unit, wherein when the ink jet unit is receiving energy provided by the driving circuit, the switch is opened;

wherein when the ink jet unit receives an ink jet signal via the control end, the ink jet unit is capable of spitting ink via the corresponding nozzle according to the energy received via the input end;

the method comprising;

transmitting the ink jet signal to the control end of the ink jet unit; and measuring currents flowing through the input end of the ink jet unit and the switch when the switch is closed.

8. The method of claim 7 wherein when proceeding with measuring currents flowing through the input end of the ink jet unit, if the currents flowing through the input end of the ink jet unit are different from a predetermined value, the method further comprises reporting that the ink jet unit has an open-circuit problem.

9. The method of claim 8 wherein the ink jet printer further comprises a plurality of ink jet units; the method further comprising:

using the other ink jet units to replace an ink jet unit to spray ink according to a predetermined method if the ink jet unit has an open-circuit problem.

10. The method of claim 7 wherein the ink jet printer further comprises a current-providing circuit having a current end, and the current-providing circuit provides a corresponding current according to a resistance of the current end; the method farther comprises connecting the current end to the input end of the ink jet unit when proceeding with measuring the current flowing through the input end of the inkjet unit.

11. The method of claim 10 wherein the switch is electrically connected between the current end of the current-providing circuit and the input end of the ink jet unit for controlling the electric connection between the current end and the input end; the method further comprises closing the switch to connect the input end to the current end when proceeding with connecting the input end of the ink jet unit to the current end of the current-providing circuit.

12. The method of claim 7 wherein the ink jet unit further comprises a heating element connected to the input end, and when the heating element is receiving energy via the input end, the heating element heats ink and the corresponding nozzle then sprays the heated ink.

13. The method of claim 7 wherein the driving circuit and the switch are controlled independently of one another.

14. An ink jet printer comprising:

a driving circuit for providing energy;

an address circuit for providing an ink jet signal;

at least an ink jet unit having a corresponding nozzle, an input end connected to the driving circuit, and a control end connected to the address circuit; wherein when the ink jet unit receives the ink jet signal via the control end, the ink jet unit is capable of spitting ink via the corresponding nozzle according to the energy received via the input end;

a current-providing circuit having a current end; the current-providing circuit providing a corresponding current according to a resistance of the current end;

a switch connected between the input end of the ink jet unit and the current-providing circuit for controlling an electric connection between the input end and the current end; wherein when the switch is closed, the input end is connected to the current end, when the switch is opened, the input end is not connected to the current end, and wherein when the driving circuit provides to the ink jet unit, the switch is opened; and a measuring circuit for generating a corresponding detecting signal according to currents provided by the current-providing circuit via the current end;

wherein when the switch is closed, the driving circuit stops providing energy to the ink jet unit.

15. The printer of claim 14 wherein when the switch is closed, the driving circuit stops providing energy to the ink jet unit, and when the address circuit does not provide the ink jet signal to the ink jet unit, the measuring circuit generates a corresponding short-circuit detecting signal according to currents provided by the current-providing circuit via the current end.

16. The printer of claim 14 wherein when the switch is closed, the driving circuit stops providing energy to the ink jet unit, and when the address circuit provides the ink jet signal, the measuring circuit generates a corresponding open-circuit detecting signal according to currents provided by the current-providing circuit via the current end.

17. The printer of claim 14 wherein the ink jet unit further comprises a heating element connected to the input end; when the heating element receives energy via the input end, the heating element heats ink and then the corresponding nozzle sprays the heated ink.

18. The printer of claim 14 wherein the driving circuit and the switch are controlled independently of one another.

* * * * *